US006491468B1

(12) United States Patent
Hagen

(10) Patent No.: US 6,491,468 B1
(45) **Date of Patent: *Dec. 10, 2002**

(54) FOAM BACKED JOINT SEAL SYSTEM

(75) Inventor: Peter Hagen, Harbor Springs, MI (US)

(73) Assignee: Sealex, Inc., Harbor Springs, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/132,686

(22) Filed: Aug. 12, 1998

Related U.S. Application Data

(60) Provisional application No. 60/055,582, filed on Aug. 12, 1997.

(51) Int. Cl.[7] ..... E01C 11/10; E01C 11/04; E04F 15/14; E04B 1/68

(52) U.S. Cl. ..... 403/291; 403/265; 404/47; 404/49; 52/396.04; 277/650; 277/652; 277/654; 277/316; 277/906

(58) Field of Search ..... 403/265, 267, 403/273, 28, 220, 225, 291, 286; 52/396.04; 404/47, 49, 74; 14/73.1; 277/316, 906, 650, 652, 654

(56) References Cited

U.S. PATENT DOCUMENTS

| | | | | | |
|---|---|---|---|---|---|
| 1,320,222 | A | | 10/1919 | Gage | |
| 1,383,459 | A | | 7/1921 | Ficklen | |
| 1,769,990 | A | | 7/1930 | Fischer | |
| 1,818,704 | A | | 8/1931 | Frantz | |
| 1,891,897 | A | | 12/1932 | Fischer | |
| 2,064,785 | A | | 12/1936 | Crandell | |
| 2,111,114 | A | * | 3/1938 | Fischer | 404/67 |
| 2,156,681 | A | | 5/1939 | Dewhirst et al. | |
| 2,210,138 | A | * | 8/1940 | Bishop | 404/66 |
| 2,220,444 | A | | 11/1940 | Gisslander et al. | |
| 2,230,688 | A | | 2/1941 | Irwin | |
| 2,290,424 | A | | 7/1942 | Grund | |
| 2,370,647 | A | * | 3/1945 | Fischer | 404/49 |
| 2,405,844 | A | | 8/1946 | Mortenson | |
| 2,431,385 | A | * | 11/1947 | Fischer | 404/49 |
| 2,539,875 | A | | 1/1951 | Van London | |
| 2,672,106 | A | | 3/1954 | Lenke | |
| 2,951,001 | A | | 8/1960 | Rubenstein | |
| 3,099,110 | A | | 7/1963 | Spaight | |
| 3,119,204 | A | | 1/1964 | Williams | |

(List continued on next page.)

FOREIGN PATENT DOCUMENTS

| | | | | |
|---|---|---|---|---|
| BE | 549606 | | 8/1956 | |
| CA | 790888 | | 7/1968 | |
| CH | 213596 | | 5/1941 | |
| DE | 614982 | | 6/1935 | |
| DE | 188741 | | 2/1957 | |
| DE | 214473 | | 4/1961 | |
| DE | 2202083 | | 7/1973 | |
| DE | 2243088 | | 3/1974 | |
| DE | 2357318 | | 5/1974 | |
| DE | 2413340 | * | 1/1980 | 52/396.04 |
| FR | 1275460 | | 10/1961 | |
| FR | 1332483 | | 6/1963 | |
| GB | 646268 | | 11/1950 | |
| GB | 748436 | | 5/1956 | |
| GB | 1350903 | | 4/1974 | |
| GB | 1380395 | | 1/1975 | |
| GB | 1478963 | | 7/1977 | |
| NL | 8501499 | * | 12/1986 | |

*Primary Examiner*—Greg Binda
*Assistant Examiner*—Ernesto Garcia
(74) *Attorney, Agent, or Firm*—Dinnin & Dunn, P.C.

(57) ABSTRACT

A foam backed precured joint seal comprising a strip of precured elastomer wider than the joint to be sealed, the strip centrally adhered along its length to an elongated foam backing.

6 Claims, 3 Drawing Sheets

U.S. PATENT DOCUMENTS 3,124,047 A 3/1964 Graham
3,145,502 A 8/1964 Rubenstein
3,150,748 A 9/1964 Liskey, Jr.
3,308,726 A 3/1967 Dreher
3,330,187 A 7/1967 Kohler et al.
3,334,557 A 8/1967 Fitzgibbon
3,334,558 A 8/1967 Atkinson
3,363,383 A 1/1968 La Barge
3,368,464 A 2/1968 Thorp, Jr. et al.
3,446,340 A * 5/1969 Mullen ..... 52/396.04
3,478,480 A 11/1969 Swenson
3,479,933 A 11/1969 Hall
3,491,499 A 1/1970 Dyer
3,520,096 A 7/1970 Kilcher
3,629,986 A 12/1971 Klittich
3,657,900 A * 4/1972 Bowser et al. ..... 206/46 R
3,680,270 A 8/1972 DeMunck
3,827,204 A * 8/1974 Walters ..... 52/396
3,829,228 A 8/1974 Miyazaki et al.
3,884,000 A 5/1975 Faleij
3,977,802 A 8/1976 Galbreath
4,023,324 A * 5/1977 Majeske ..... 52/396
4,030,852 A 6/1977 Hein
4,043,693 A 8/1977 Brown
4,058,947 A * 11/1977 Earle et al. ..... 52/396
4,067,660 A 1/1978 Puccio
4,098,047 A 7/1978 Weber
4,111,583 A 9/1978 Brady et al.
4,285,612 A 8/1981 Betti
4,287,696 A * 9/1981 Mullen ..... 52/309
4,290,249 A 9/1981 Mass
4,362,427 A 12/1982 Mass et al.
4,601,604 A * 7/1986 Clark et al. ..... 404/69
4,622,794 A 11/1986 Geortner
4,654,250 A * 3/1987 Black et al. ..... 428/195
4,736,558 A * 4/1988 Taraba, Jr. ..... 52/309.8
4,761,927 A 8/1988 O'Keeffe et al.
4,784,516 A * 11/1988 Cox ..... 404/69
4,824,283 A * 4/1989 Belangie ..... 404/64
4,922,676 A 5/1990 Spronken
5,335,466 A * 8/1994 Langohr ..... 52/396.04

* cited by examiner

FOAM BACKED JOINT SEAL SYSTEM

This is a continuation of Provisional Application Serial No. 60/055,582 filed Aug. 12, 1997.

BACKGROUND OF THE INVENTION

1. Field of the Invention

The present invention concerns joints utilized in structures. Even more particularly, the present invention concerns the application of a premanufactured joint seal system (a joint seal system with a finished, dry surface) allowing expansion and contractions of different construction members.

2. Description of the Prior Art

In the construction of buildings and roads having multiple panels therein, there has long existed the need for joints and other similar means to connect substrates and accommodate the expansion and construction of these substrates due to thermal conditions. Such joints used in highways have been termed horizontal joints. Those utilized in buildings notably in skyscrapers, have been termed vertical joints. Those joints within buildings which interconnect with vertical joints or other vertical members are termed vertical-horizontal joints.

In selecting among the known materials to form a vertical joint, architects and specifiers have suggested the use of elastomeric sealant such as silicone sealant or organic based sealant. These types of sealants are normally applied wet into a joint opening. Before solidifying, some sealant types would readily sag and slump within the joint especially wider joints and/or collect dirt due to its wet surface in the uncured stage and/or are permanently deformed due to movement of the construction members while the sealant has not totally cured. This produced an uneven joint, which could not perform in the needed manner nor insure a watertight seal.

An example of one method of attempting a silicone seal over a wide vertical joint is described in U.S. Pat. No. 5,335,466 to Langohr. Langohr utilizes an open foam backer to maintain the position of an in place cured sealant strip; the backer and cured sealant strip cooperate to form a pair of grooves which are then filled with an uncured silicone sealant. This system requires a time consuming and labor intensive manufacturing process of depositing and curing a strip of silicone on the foam backing and then an installation process of dual beads of silicone sealant after the foam backing is installed (exposing uncured sealant during application). The resulting seal relies upon four bonds formed by the two beads (each bead forms one bond with the structure and one bond with the cured sealant). Contact between the cured sealant and the structure is only effected by the application of the bead sealant (Col 3, Line 67–Col 4, Line 1). The Langohr system is very wasteful of silicone sealant. The depth of the cured sealant strip (and thus two sealant beads) is substantial to permit sufficient uncured sealant to be added to assure the beads are sufficiently uniform to effect a watertight seal even with flow between application and cure and a smoothing operation for appearance. Further, the three bead appearance is not preferred, particularly where the center bead width differs from the width of the beads of uncured sealant applied. Further still, the foam backer remains adhered to the cured sealant and the bead sealant to provide structural stability to the joint. Another disadvantage is the appearance of the joint if there has been shifting and the space is uneven; the cured sealant will be uniform but the bead sealant will be uneven. Further, wet sealant can collect dirt or debris while curing, creating an unsightly appearance.

SUMMARY OF THE INVENTION

The present invention provides a decorative and easily formed sealing strip for wide vertical joints, which covers the joint with a performed uniform strip or forms a U-shaped seal by inserting the sealing strip deeper into the joint. The present invention also provides a "dry" outer seal for all types of joints, wide or narrow, vertical or horizontal, which will not deform due to shifting and which will not collect surface debris as the adhesive dries.

The seal of the present invention comprises:

a) a resilient backing member for compression insertion into a joint b) an elastomeric sealing strip disposed on the backing member and wider than the joint, and c) an adhesive joining a central elongated portion of the sealing strip to the backing member.

The backing member holds the sealing strip in place during installation and centers the strip relative to the joint, holding the strip in place while an added adhesive sets. There are various configurations for the backing member to reduce cost, to facilitate insertions, and if needed to minimize adhesion between the backing member and the sealing strip. It is preferred that the sealing strip is adhered to the backing member in a way so that the reaction to expansion or contraction in the joint does not effect the sealant strip. The sealing strip is adhered directly to the structure below the edge on either side with an added adhesive. Thus, adhesive is never exposed to the open. The resultant seal is watertight and yet flexible enough to endure the expansion and contraction of the joint.

Other objects, features and advantages of the present invention will become apparent from the subsequent description and appended claims, taken in conjunction with the accompanying drawings.

DETAILED DESCRIPTION OF THE PREFERRED EMBODIMENTS

Figure 1:
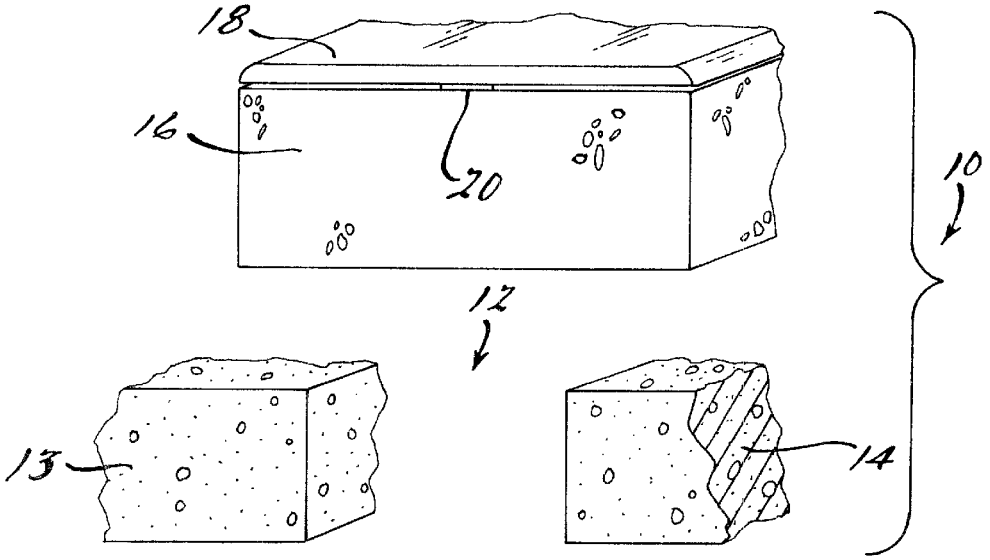
FIG. 1 is a perspective view of a first embodiment of the present invention to be deployed to seal two substrates.

With reference now to FIG. 1, there is shown therein a first embodiment of the present invention, to wit, a seal 10 for a joint 12. The joint 12 is formed by two adjacent or abutting substrates or slabs 13, 14. The substrates 13, 14 may comprise any of the commonly known building materials, such as concrete, brick, steel or other metals, and glass. The substrates 13, 14 define the joint 12. The seal 10 comprises a backer 16 and a strip of an elastomeric sealing strip 18. The seal 10 is a unitary portable sealing member or expandable joint. Stated another way, the seal 10 is a portable unitary seal that may be manipulated as a single member, and may be installed into a gap or joint in a structure as a one-piece unit. The backer 16 comprises a resilient yet sturdy material. In the preferred embodiment, the backer 16 comprises a flexible open cell polyurethane foam. Other suitable material, such as closed or open flexible foam materials which are commonly used in construction may be used. The backer is wider than the joint 12 so as to require a compression fit into the joint 12.

The sealing strip 18 is at least as wide as the backer 16 and is wider than the joint. The sealing strip 18 is preferably an elastomeric extruded strip of silicone. The strip is preferably thin, flexible, and elongate and is adhered to the backer 16 in the midsection area, leaving on each side a flap 19 which is not attached to the backer and which provides an adhesive area during the installation. A discrete layer of adhesive in the middle section 20 holds the strip 18 to the backer mainly for installation purposes.

Figure 2:
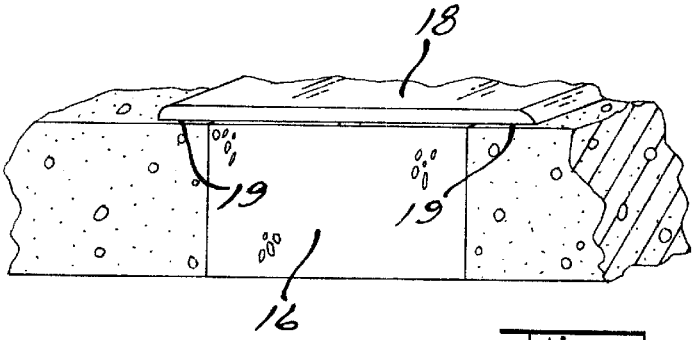
FIG. 2 is a perspective view of the first embodiment of the present invention deployed to seal two substrates.
Figure 3:
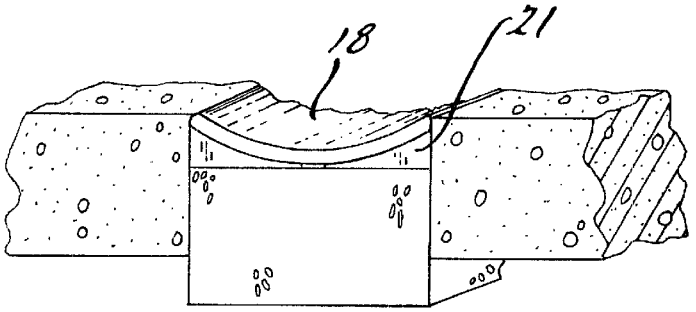
FIG. 3 is a perspective view of the first embodiment of the present invention deployed in an alternate manner to seal two substrates.

The seal 10 is alternatively deployed in the joint in the following two manners:

a) (FIG. 2) The backer 16 is compressed and inserted within the gap 12 until the sealing strip lays flat upon the substrates 13 and 14 and, the flaps 19 overlap both substrates 13 and 14 (FIG. 2). A small amount of adhesive 21 is applied under each side of the strip 18 (flap 19) overlapping the substrates 13 and 14, adhering the strip 18 directly to the top of facing surface of the substrates to create a waterproof or weatherproof seal between the sealing strip 18 and the substrates 13 and 14.

b) The backer 16 is compressed and inserted into the joint-gap so the strip 18 forms a U-shaped seal bending the flaps 19 (FIG. 3) to the outside edges of the joint. A small amount of adhesive 21 is applied under each side of the flaps 19 bridging the substrates 13 and 14, to create a waterproof or weatherproof seal between the sealing strip 18 and the substrates 13 and 14. The indented of concave surface gives a final appearance such as a bead of caulk.

Figure 4:
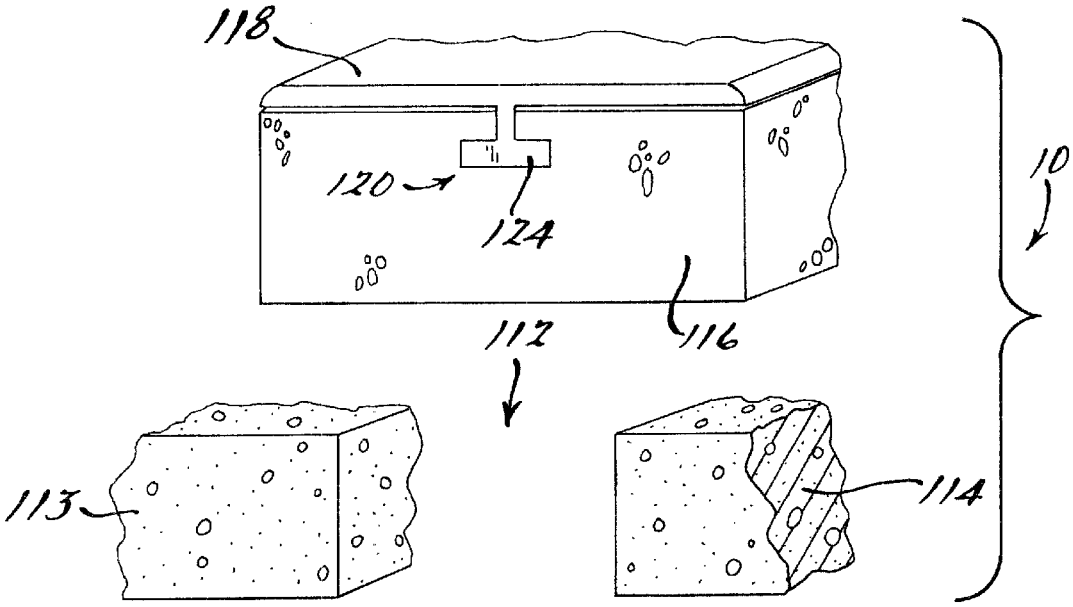
FIG. 4 is a perspective view of a second embodiment of the present invention to be deployed to seal two substrates.
Figure 5:
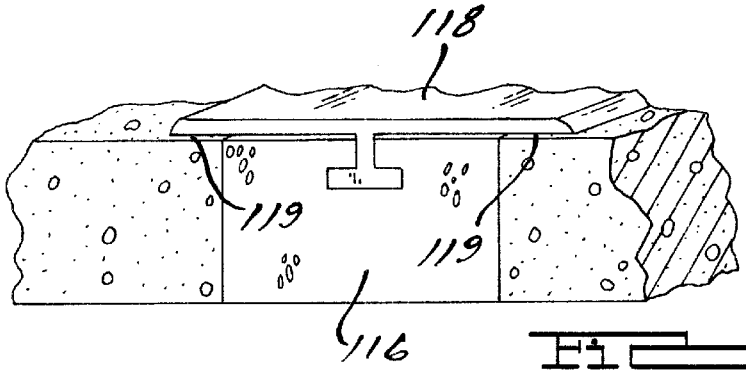
FIG. 5 is a perspective view of the second embodiment of the present invention deployed to seal two substrates.
Figure 6:
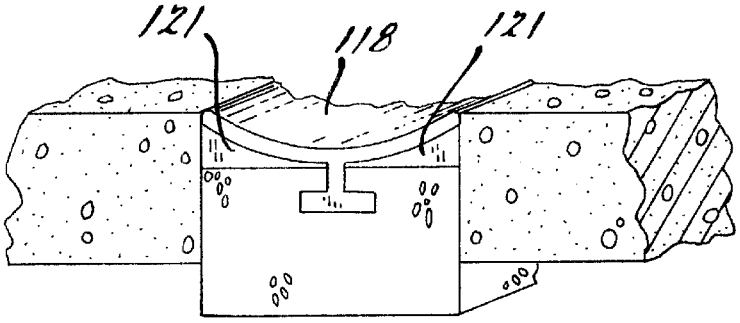
FIG. 6 is a perspective view of the second embodiment of the present invention deployed in an alternate manner to seal two substrates.

An alternative embodiment of the invention is shown at FIGS. 4–6. In FIGS. 4–6, reference numerals 112, 113, 114, 118, 119, and 121 refer to features similar to the features having corresponding two-digit reference numerals described in regard to FIGS. 1–3, namely 12, 13, 14, 13, 19, and 21, respectively. The sealing strip 118 is attached to the foam backing 116 through the use of an elongated groove 124 within the foam backing, preferably T-shaped as shown. The groove 124 may be formed during the extrusion process, and the liquid adhesive 120 applied to the groove, which will then cure after the seal is applied onto the backing. As such adhesives adhere better to the seal than the foam backing, the T-shaped groove greatly improves the adhesion between the seal 118 and the backing 116 while requiring a minimum contact between the seal 118 and the backing 116. This allows the seal to flex as shown in FIG. 6 without separation from the backing 116. Alternatively, the sealing strip 118 could be formed (through extrusion) with a mating protrusion (T-shaped in FIGS. 4–6) which could be inserted into the backer 116 and eliminate the need for adhesive.

Figure 7:
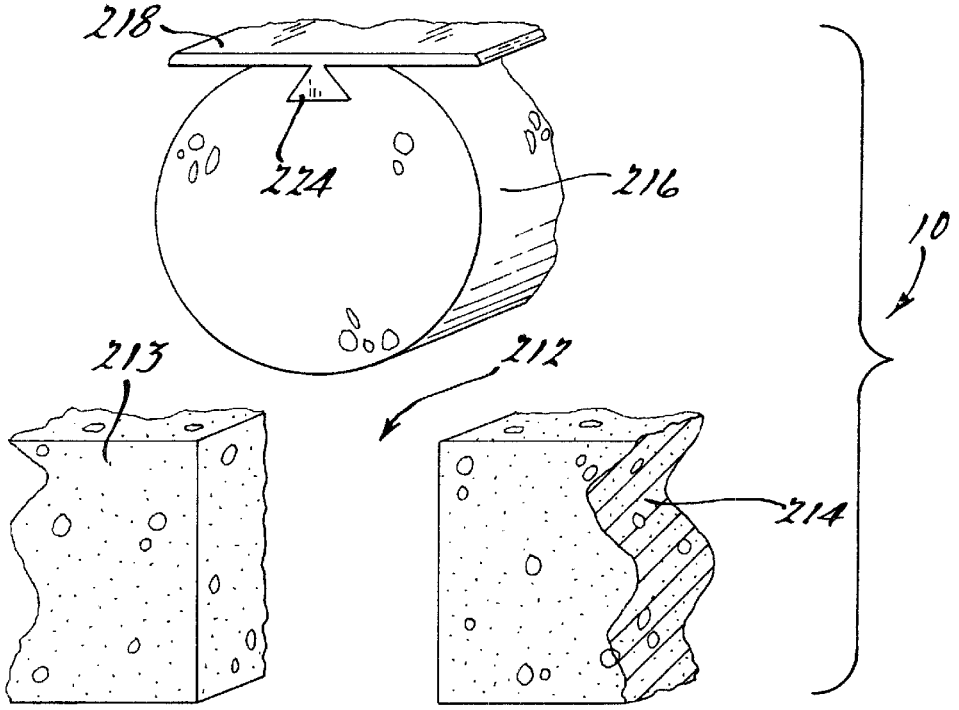
FIG. 7 is a perspective view of a third embodiment of the present invention to be deployed to seal two substrates.
Figure 8:
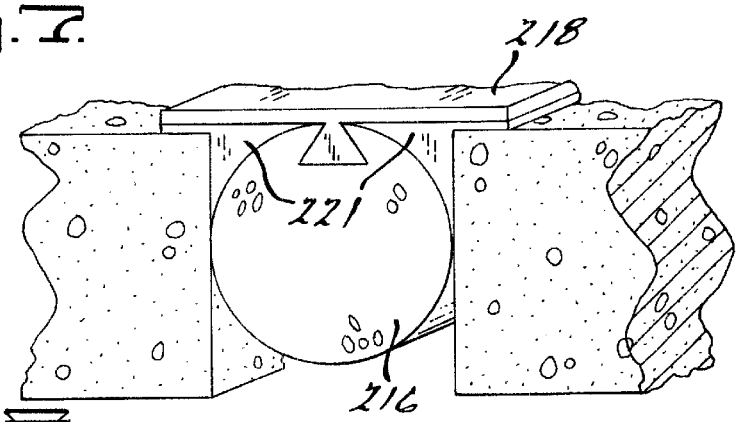
FIG. 8 is a perspective view of the third embodiment of the present invention deployed to seal two substrates.
Figure 9:
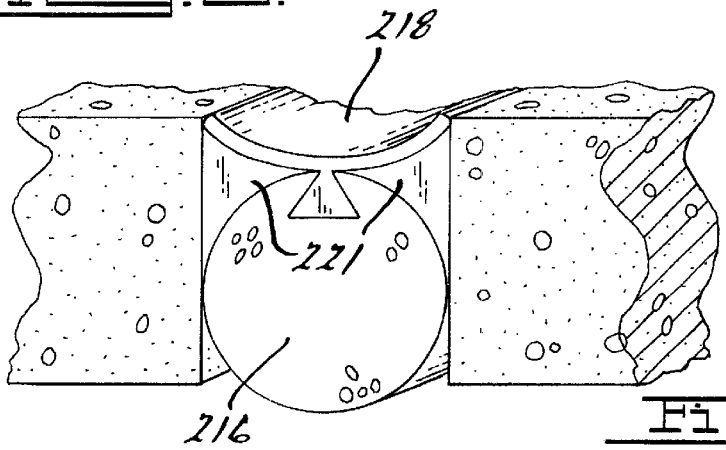
FIG. 9 is a perspective view of the third embodiment of the present invention deployed in an alternate embodiment to seal two substrates.

An alternate form of this additional embodiment is shown in FIGS. 7–9, in which a cylindrical foam backing 216 is used. In the embodiment shown in FIGS. 7–9, references numerals 212, 213, 214, 218, and 221 refer to features similar to the features having corresponding two-digit reference numerals described in regard to FIGS. 1–3, namely 12, 13, 14, 18 and 21, respectively. The round cross section allows the backing to be inserted more easily and provides greater space for the additional adhesive 221. For purposes of illustration a triangular groove 224 is shown, which provides the improved adhesion between seal and backing discussed above.

In view of the foregoing, it is to be understood that the drawings, discussion and description herein are merely meant to represent particular embodiment of the invention and are not meant to be a limitation upon the practice thereof. It is the following claims, including all equivalents, which define the scope of the invention.

What is claimed is:

1. A portable unitary seal for effecting a joint in a space between adjacent substrates of a structure, the seal comprising:

an elongated open-foam compressible backer, said backer containing a centrally located groove;

an elongated elastomeric strip of cured sealant having a substantially constant width fixed to said backer, wherein the width of said backer is more narrow than said width of said strip of cured sealant at a point adjacent to said sealant; and said elastomeric strip includes an elongated tang matingly received within said groove.

2. The seal of claim 1 wherein the width of said backer is more narrow than said width of said strip of cured sealant at a point distal to said sealant.

3. The seal of claim 1 wherein said backer has a generally rounded cross section.

4. A unitary portable seal for effecting a joint in a space adjacent substrates of a structure, the seal comprising:

an elongated elastomeric strip of cured sealant having a substantially constant width disposed on said backer;

adhesive centrally located substantially along the length of said elastomeric strip; wherein said backer contains a centrally located groove and said adhesive is located within said groove.

5. A unitary portable expandable joint for connecting substrates in a structure separated by a space, the joint comprising:

an elongated compressible open-foam backer for insertion into said space; and a thin flexible elongated strip of cur ed sealant fixed upon and aligned along its length with said backer, said sealant having a substantially uniform width and having lateral edges deformable from said backer;

a wet adhesive deployed substantially along each edge of said strip of cured sealant, forming when dry a bond between each of said substrates and the cured sealant.

6. A unitary portable expandable joint for connecting substrates in a structure separated by a space, the joint comprising:

an elongated compressible open-foam backer for insertion into said space; and a thin flexible elongated strip of cured sealant fixed upon and aligned along its length with said backer, said sealant having a substantially uniform width and having its lateral edges deformable from said backer, wherein said cured sealant assumes a concave cross section; and a wet adhesive deployed substantially along each edge of said strip of cured sealant, forming when dry a bond between each of said substrates and the cured sealant.

* * * * *

UNITED STATES PATENT AND TRADEMARK OFFICE

CERTIFICATE OF CORRECTION

PATENT NO. : 6,491,468 B1
DATED : December 10, 2002
INVENTOR(S) : Peter Hagen

It is certified that error appears in the above-identified patent and that said Letters Patent is hereby corrected as shown below:

Column 3,
Line 50, change the second "13" to -- 18 --

Column 4,
Line 46, change "cur ed" to -- cured --

Signed and Sealed this

Twentieth Day of May, 2003

JAMES E. ROGAN
*Director of the United States Patent and Trademark Office*